US006186607B1

(12) United States Patent
Remby

(10) Patent No.: US 6,186,607 B1
(45) Date of Patent: Feb. 13, 2001

(54) DISPLAY AND STORAGE UNIT

(76) Inventor: Thomas D. Remby, 6277 'F' Variel Ave., Woodland Hills, CA (US) 91367

( * ) Notice: Under 35 U.S.C. 154(b), the term of this patent shall be extended for 0 days.

(21) Appl. No.: 09/495,219

(22) Filed: Jan. 31, 2000

(51) Int. Cl.[7] ..... A47B 43/00
(52) U.S. Cl. ..... 312/257.1; 312/258
(58) Field of Search ..... 312/107, 108, 312/111, 140.1, 140.2, 140.3, 140.4, 234, 234.4, 234.5, 257.1, 258, 249.8, 244; 208/47.19

(56) References Cited

U.S. PATENT DOCUMENTS

| | | | | |
|---|---|---|---|---|
| 4,082,388 | | 4/1978 | Goeglein . | |
| 4,417,774 | * | 11/1983 | Bevan et al. | 312/258 X |
| 4,582,003 | | 4/1986 | Valero . | |
| 4,875,590 | | 10/1989 | Martin et al. . | |
| 5,022,721 | * | 6/1991 | Melgers | 312/257.1 |
| 5,105,954 | | 4/1992 | Dahlquist . | |
| 5,480,225 | * | 1/1996 | Bailey | 312/258 |
| 5,642,898 | * | 7/1997 | Wise | 208/47.19 |
| 5,735,586 | * | 4/1998 | Cheng | 312/258 X |

FOREIGN PATENT DOCUMENTS

| | | | | |
|---|---|---|---|---|
| 405167 | * | 2/1934 | (GB) | 312/140.2 X |

* cited by examiner

*Primary Examiner*—Anthony D. Barfield
*Assistant Examiner*—Michael J. Fisher
(74) *Attorney, Agent, or Firm*—Polster, Lieder, Woodruff & Lucchesi, LC

(57) ABSTRACT

A display and storage unit comprises a base unit having a front and a storage area within the base unit, a pair of movable sides attached to the base unit capable of being positioned between an open position and a closed position, a counter top attached to the front of the base unit capable of being positioned between an open position and a closed position, the counter top being positioned in the open position when the movable sides are in the open position, the pair of movable sides being secured to the counter top for securing the counter top and the sides in the open position and a display unit capable of being positioned on the base unit when the counter top and the sides are in the open position.

18 Claims, 5 Drawing Sheets

DISPLAY AND STORAGE UNIT

BACKGROUND OF THE INVENTION

This invention relates to a display and storage unit and more particularly to a display and storage unit used for storing and displaying various products for sale and use.

Many department stores and malls have specialized departments or areas for gift wrapping. In particular, once a purchase of a product or a gift is made, the customer must locate and proceed to the specific location within the store or mall in order to get a purchased item gift wrapped. Not only is this inconvenient for the customer, it also takes up valuable space in the store which could be used for displaying additional merchandise. Additionally, since such gift wrapping stations are by their very nature stationary, if a special event is being held where it would be advantageous to wrap a product immediately, such stationary locations would be unacceptable. Further, depending upon what season it is, it may be necessary to provide more than one gift wrapping location due to the high volume of shoppers requiring gift wrapping. Further, it may be necessary for a store to be remodeled and the designated location for gift wrapping may have to be moved or relocated. This adds to the cost for remodeling and also further adds to the confusion of having a customer relocate the gift wrapping department.

The present invention is designed to obviate and overcome many of the disadvantages and shortcomings associated with having a single specified location for gift wrapping. The present invention can be easily used to locate a display and storage unit at various locations within a department store or a mall. A display and storage unit of the present invention may be easily moved from one location to another at various times during a day. Additionally, a display and storage unit of the present invention may be stored at a remote location during the time the store is closed to be later moved to a location within the store prior to the store opening.

SUMMARY OF THE INVENTION

The display and storage unit of the present invention comprises a base unit having a front and a storage area within the base unit, a pair of movable sides attached to the base unit capable of being positioned between an open position and a closed position, a counter top attached to the front of the base unit capable of being positioned between an open position and a closed position, the counter top being positioned in the open position when the movable sides are in the open position, the pair of movable sides being secured to the counter top for securing the counter top and the sides in the open position and a display unit capable of being positioned on the base unit when the counter top and the sides are in the open position.

In another form of the present invention, a display and storage unit comprises a base unit having a front and a storage area within the base unit, a pair of movable sides attached to the base unit capable of being positioned between an open position and a closed position, a counter top attached to the front of the base unit capable of being positioned between an open position and a closed position, the counter top being positioned in the open position when the movable sides are in the open position, the pair of movable sides being secured to the counter top for securing the counter top and the sides in the open position, the movable sides further each comprising a pair of spaced apart blocks and a display unit capable of being positioned on the base unit when the counter top and the sides are in the open position, the display unit comprising a spline, the spaced apart blocks for receiving the spline for securing the display unit to the base unit.

In still another form of the present invention, a display and storage unit comprises a base unit having a front and a storage area within the base unit, a pair of movable sides attached to the base unit capable of being positioned between an open position and a closed position, a counter top attached to the front of the base unit capable of being positioned between an open position and a closed position, the counter top being positioned in the open position when the movable sides are in the open position, the pair of movable sides being secured to the counter top for securing the counter top and the sides in the open position, the movable sides each further comprising a leveling mechanism for leveling the unit when the counter top and the sides are in the open position and a display unit capable of being positioned on the base unit when the counter top and the sides are in the open positions.

In light of the foregoing comments, it will be recognized that a principal object of the present invention is to provide an improved display and storage unit for gift wrapping services and supplies.

A further object of the present invention is to provide a display and storage unit which is of simple construction and design and which can be easily employed with highly reliable results.

Another object of the present invention is to provide a display and storage unit which is easy to operate, move, and store at various locations within a department store, a mall, or at a location outside of either of the department store or the mall.

A still further object of the present invention is to provide a display and storage unit which is easily assembled for use and disassembled for storage.

These and other objects and advantages of the present invention will become apparent after considering the following detailed specification in conjunction with the accompanying drawings, wherein:

DETAILED DESCRIPTION OF THE PREFERRED EMBODIMENTS

Figure 1:
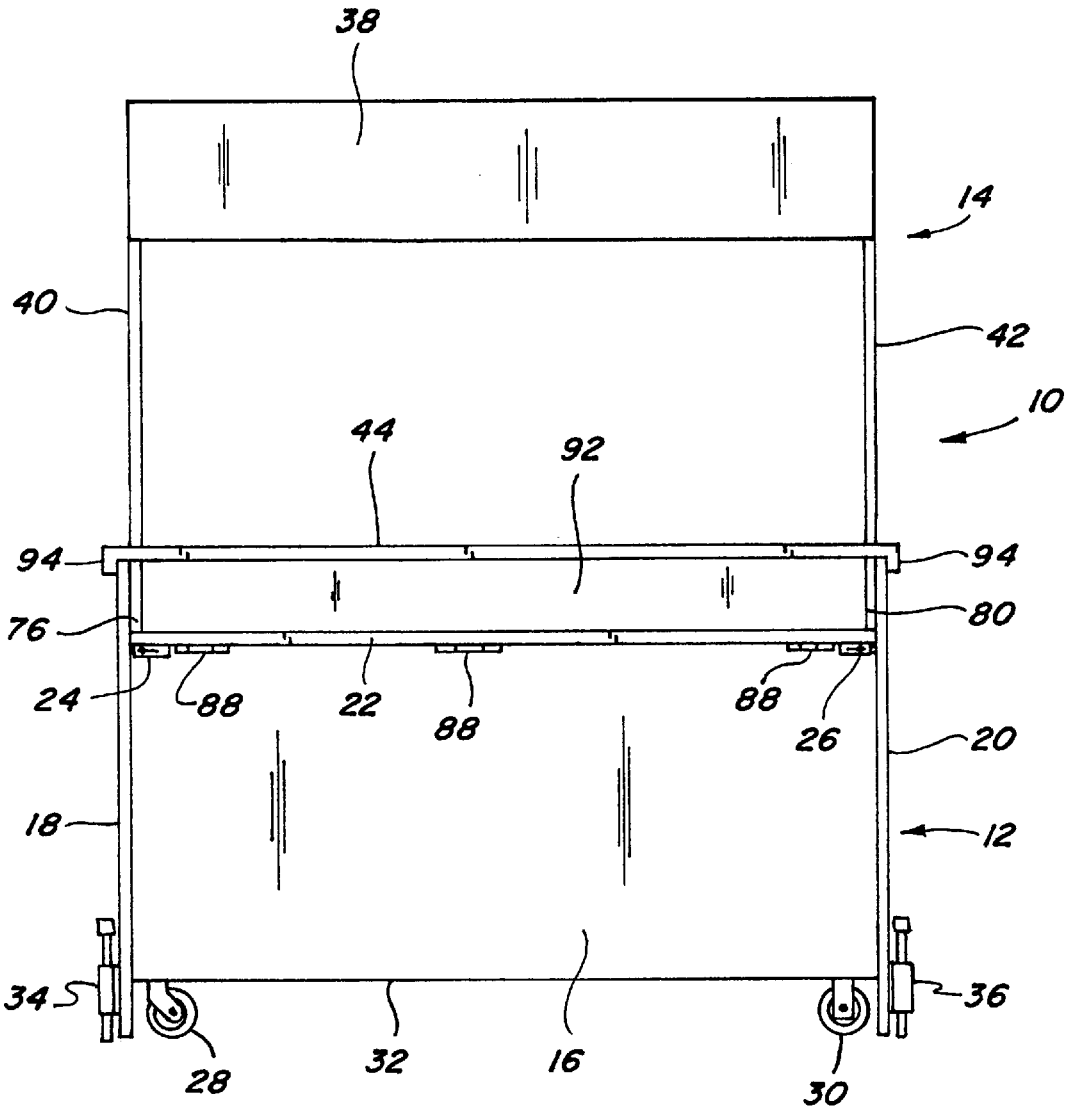
FIG. 1 is a front elevational view of a display and storage unit constructed according to the present invention.

Referring now to the drawings, wherein like numbers refer to like items, number 10 identifies a preferred embodiment of a display and storage unit constructed according to the present invention. The unit 10 is shown in FIG. 1 to comprise a base unit 12 and a display unit 14 which is adapted to be mounted on the base unit 12. The base unit 12 is constructed to have a front 16 and a pair of movable sides 18 and 20. The pair of movable sides 18 and 20 are capable of being positioned between an open position and a closed position and the sides 18 and 20 are illustrated as being in the open position in FIG. 1. A counter top 22 is attached to the front 16 of the base unit 12 and is also capable of being positioned between an open position and a closed position. The counter top 22 is shown being in the open position in FIG. 1. The counter top 22 has locks or locking mechanisms 24 and 26 associated with the counter top 22 for securing the sides 18 and 20 to the counter top 22 when the sides 18 and 20 and the counter top 22 are in the open position. The display and storage unit 10 has wheel assemblies or wheels 28 and 30 on an underside or bottom 32 of the base unit 12 which facilitates moving the unit 10. The wheel assemblies 28 and 30 may include a locking mechanism (not shown) for locking the wheels to prevent movement. A pair of stops or leveling mechanisms 34 and 36 are included on the sides 18 and 20, respectively. The leveling mechanisms 34 and 36 serve the dual purpose of leveling the unit 10 when the unit 10 is positioned in an area or location which is not level and also to prevent movement of the unit 10 during use.

The display unit 14 is positioned and secured in place on the base unit 12, as will be explained. The display unit 14 includes a display portion 38 on which items or banners may be attached for display purposes. The display unit 14 also has a pair of side 40 and 42 and a counter top 44 which is located above the counter top 22.

Figure 2:
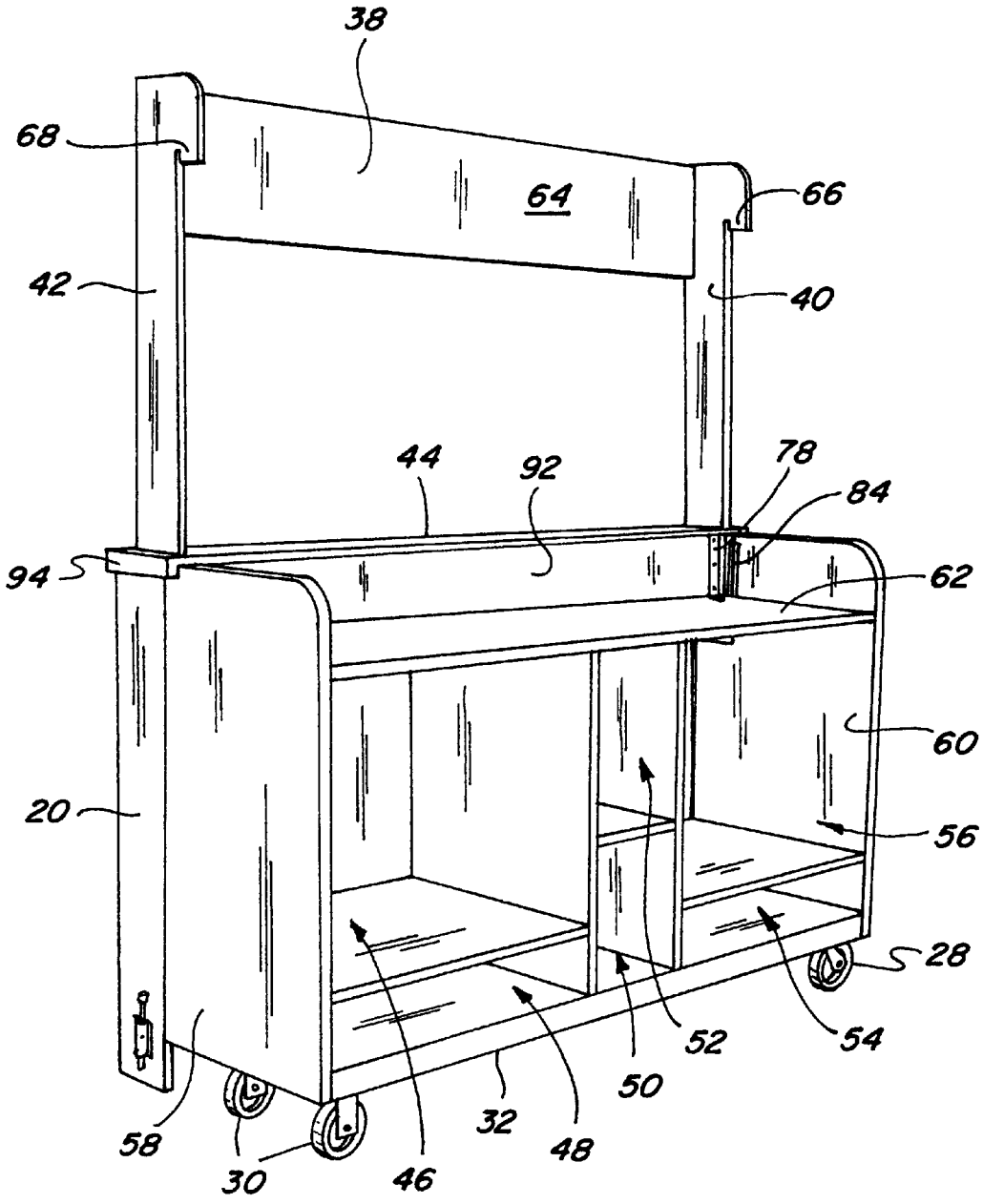
FIG. 2 is a rear perspective view of the display and storage unit shown in FIG. 1.

Referring now to FIG. 2, a rear perspective view of the display and storage unit 10 is shown. The base unit 12 has various storage areas or compartments 46, 48, 50, 52, 54, and 56 for storing supplies or other materials which are used in conjunction with the unit 10. The base unit also has a pair of sides 58 and 60 and a work top or counter top 62. The display unit 14 has the display portion 38, the sides 40 and 42, and the counter top 44. The display portion 38 has a backside 64 on which items or banners may be placed. Additionally, the backside 64 may display other information which the user of the unit 10 needs to know, for example, a price list. The sides 40 and 42 further each have a hook portion 66 and 68, respectively, which are used to attach the display unit 14 to the base unit 12 for storage or transporting the unit 10, as will be explained.

Figure 3:
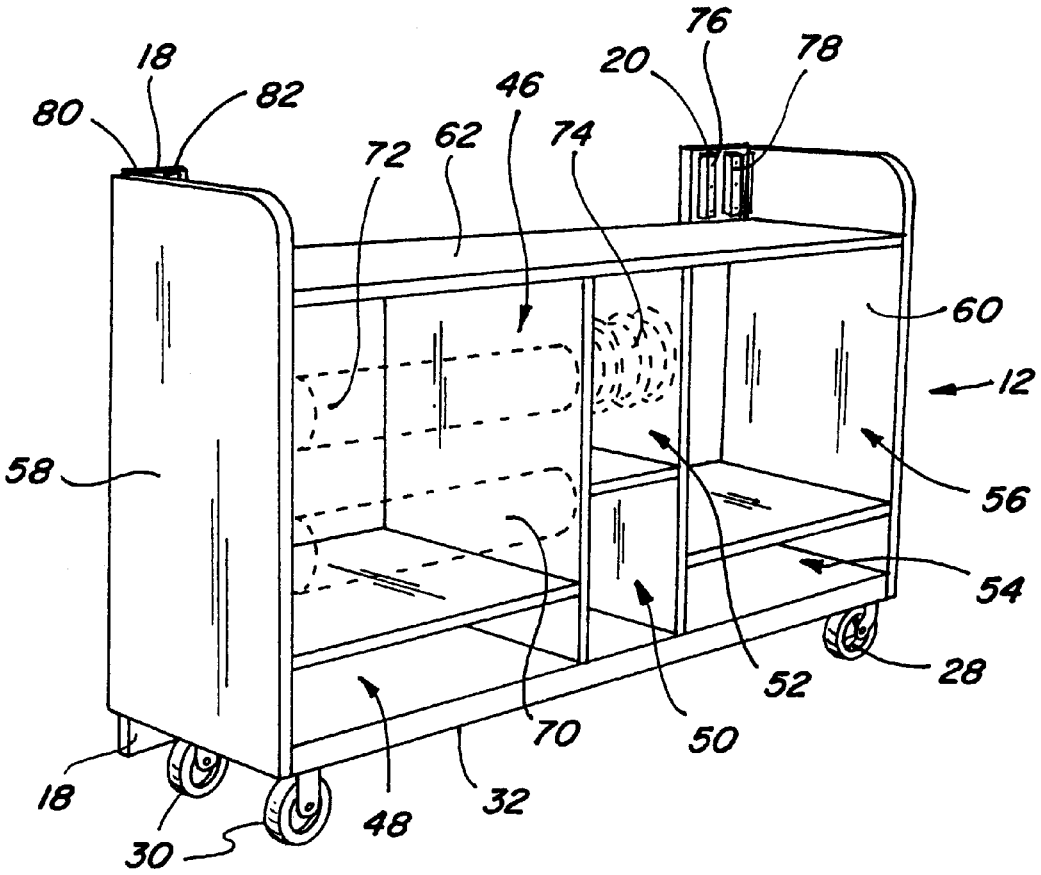
FIG. 3 is a rear elevational view of the display and storage unit shown in FIG. 1 with the display and storage unit being shown in a closed position and the display unit removed.

With reference now to FIG. 3, the base unit 12 of the display and storage unit 10 is illustrated with the sides 18 and 20 in the closed position and the display portion 14 removed from the base unit 12. The base unit 12 is also shown having rolls of wrapping paper 70 and 72 placed in the storage compartment 46 and ribbon 74 positioned in the storage compartment 52. The rolls 70 and 72 and the ribbon 74 are shown in phantom and only suggest what may be stored in the various compartments 46–56. As can be appreciated, all of the supplies, such as the rolls 70 and 72 and the ribbon 74, are stored within the unit 10 and do not have to be unloaded when the unit 10 is in the closed position or is being transported from one location to another. Additionally, the user of the unit 10 can easily and visually verify whether the supplies need to be restocked. This visual inspection can be accomplished whether the unit 10 is in the closed or opened position. It is also contemplated that doors or drawers (not shown) may be used in combination of the storage compartments 46–56.

The side 20 is shown having a pair of spaced apart blocks 76 and 78 which are secured to the side 20. The blocks 76 and 78 are used to secure or hold the display unit 14 in place when the sides 18 and 20 and the counter top 22 are in the open position. Additionally, although barely visible in FIG. 3, the side 18 also has a pair of spaced apart blocks 80 and 82 which are used to secure or hold the display unit 14. The manner in which the display unit 14 is positioned with the blocks 76–82 will be discussed further herein.

Figure 4:
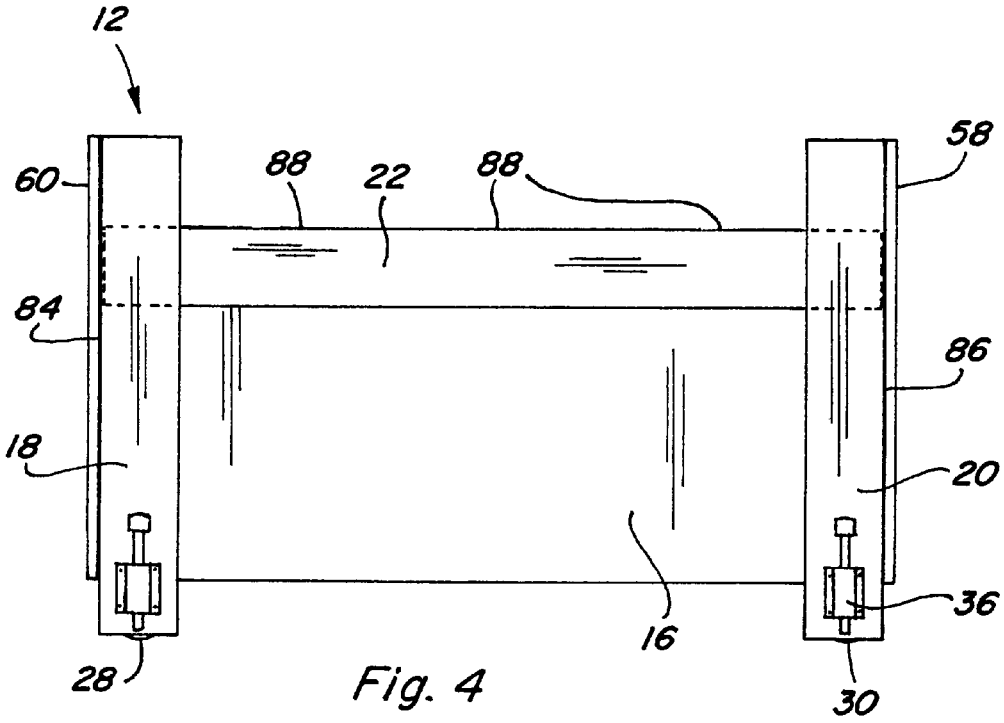
FIG. 4 is a front perspective view of the display and storage shown in FIG. 1 with the display and storage unit being shown in a closed position and the display unit being removed.

FIG. 4 depicts the base unit 12 in a stored or folded state with the display unit 14 removed from the base unit 12. In particular, the sides 18 and 20 have been moved to the closed position and the counter top 22 has also been moved to the closed position. The side 18 is connected to the side 60 by a hinge 84 which allows movement of the side 18 between the open and the closed positions. The other side 20 also has a hinge 86 which is used to attach the side 20 to the side 58 and to allow the side 20 to be moved between the open and closed positions. The counter top 22 is further shown to have hinges 88 (also shown in FIG. 1) which serve to both attach the counter top 22 to the front 16 and to facilitate positioning the counter top 22 between the open and closed positions. Although hinges 84, 86, and 88 are shown, it is also possible to have other equivalent type devices which both attach the counter top 22 or the sides 18 and 20 and allow freedom of movement between the open and closed positions. Further, the hinges 88 are illustrated as being separate hinges, however, it is also possible to have just one hinge which runs the length of the counter top 22. The hinges 84 and 86 could also be several hinges in place of the single hinge which is shown. The leveling mechanisms 34 and 36 are shown retracted but it is also possible to engage the mechanisms 34 and 36 in order to prevent movement of the unit 10 when the unit 10 is in the stored or folded state.

Figure 5:
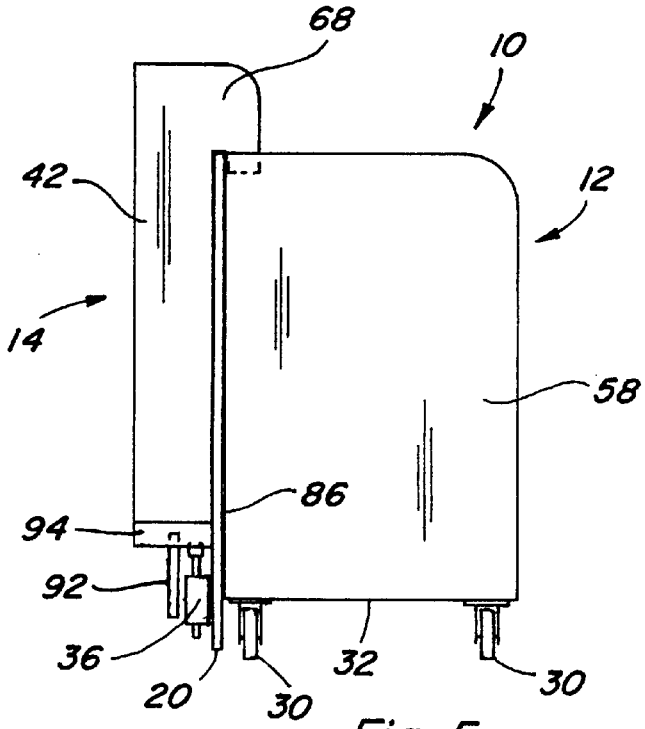
FIG. 5 is a side elevational view of the display and storage unit shown in FIG. 1 with the display and storage unit being shown in a closed position and the display unit being stored in place on the unit.

With reference now to FIG. 5, the unit 10 is illustrated with the display unit 14 being stored in place on the base unit 12 with the sides 18 and 20 and the counter top 22 being in the closed positions. The hook portion 68 of the side 42 of the display unit 14 is shown to be able to be positioned on the side 20 to secure the display unit 14 on the base unit 12. In this position, the unit 10 may be easily moved for storage or for transportation to another location. Additionally, in order to be able to secure the display unit 14 on the base unit 12, the sides 18 and 20 and the counter top 22 must be positioned in their closed positions. This further allows the unit 10 to be stored in a minimal amount of space. As can be appreciated, although now shown in FIG. 5, the hook portion 66 of the other side 40 of the display unit 14 is also adapted to be placed on the side 18 of the base unit 12. In this manner the display unit 14 is secured in place on the base unit 12.

Figure 6:
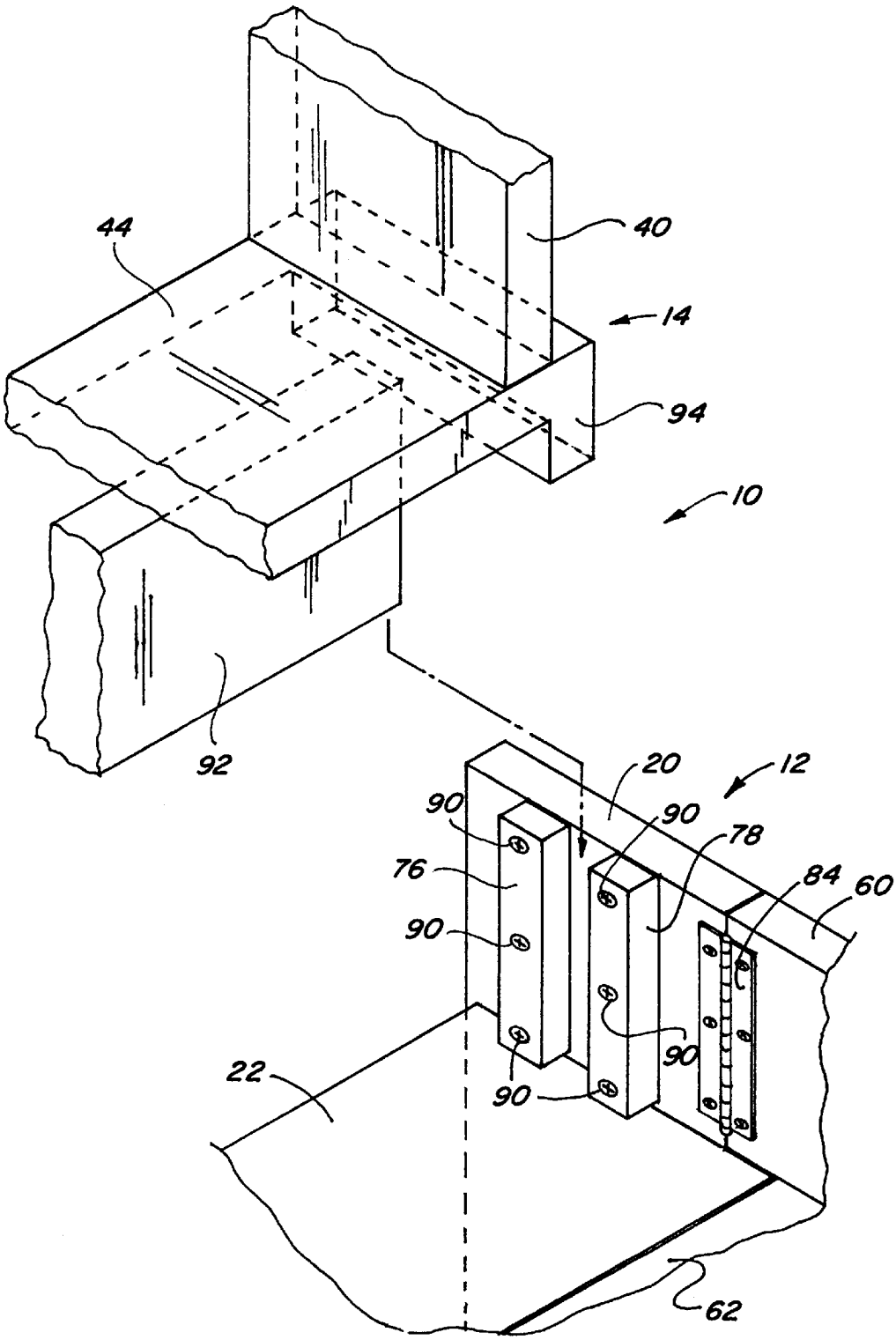
FIG. 6 is a partial fragmentary view illustrating the manner in which the display unit is attached to the base unit.

FIG. 6 shows one embodiment in which the display unit 14 may be attached or secured to the base unit 12 when the display and storage unit 10 is fully assembled. As has been previously described, the movable side 20 has a pair of blocks 76 and 78 which are attached to the side 20 by any suitable means, such as screws 90. The blocks 76 and 78 are spaced apart a predefined distance which corresponds to the thickness of a board, cross member, or a spline 92 which is part of the display unit 14. The blocks 76 and 78 receive the spline 92 and the spline 92 also rests upon the counter top 22. Although not shown in FIG. 6, the other end of the spline 92 is adapted to fit between the blocks 80 and 82 which are secured to the movable side 18. The spline 92 is shown to span the distance between the sides 40 and 42 of the display unit 14. The display unit 14 also has a cap portion 94 at each of the ends of the counter top 44 and both of the caps 94 are positioned over the sides 18 and 20 (see FIG. 1). By using the arrangement of the spline 92 and the blocks 76–82 the display unit 14 may be easily inserted into and removed from the base unit 12. Additionally, the blocks 76–82 may be used to allow the hook portions 66 and 68 to be inserted into the blocks 76–82 during storage to further secure the display unit 14 to the base unit 12. In particular, the thickness of each of the hook portions 66 and 68 is slightly less than the space between the blocks 76–78 and the blocks 80–82. This again provides for easy insertion and removal of the display unit 14 from the base unit 12.

It should be recognized that the display and storage unit of the present invention can be constructed of various materials and can be assembled from separable components. Preferably, the display and storage booth will be of relatively lightweight and strong material so that it can be easily positioned, removed, and transported to other locations or for storage. The display and storage unit of the present invention is also capable of being used to display and store various other components than gift wrapping supplies. For example, the present display and storage unit is capable of being used at various other locations other than retail establishments such as in residential use. The display and storage unit may be used in the home as a sewing supply center, in the garage as a storage unit for storing supplies needed in a garage, or as a unit for storing barbecue supplies on a patio.

From all that has been said, it will be clear that there has thus been shown and described herein a display and storage unit which fulfills the various objects and advantages sought therefor. It will be apparent to those skilled in the art, however, that many changes, modifications, variations, and other uses and applications of the subject display are possible and contemplated. All changes, modifications, variations, and other uses and applications which do not depart from the spirit and scope of the invention are deemed to be covered by the invention, which is limited only by the claims which follow.

What is claimed is:

1. A display and storage unit comprising:

a base unit having a front and a storage area within the base unit, a pair of movable sides attached to the base unit with the movable sides capable of being positioned between an open position and a closed position, a counter top attached to the front of the base unit capable of being positioned between an open position and a closed position, the counter top being positioned in the open position when the movable sides are in the open position, the pair of movable sides being secured to the counter top for securing the counter top and the sides in the open position; and a display unit capable of being positioned on the base unit when the counter top and the side are in the open position, the display unit further comprising a pair of hook portions which are adapted to be positioned on the movable sides when the counter top and the movable sides are in the closed positions.

2. The display and storage unit of claim 1 wherein each of the movable sides has a leveling mechanism for leveling the unit when the sides are in the open position.

3. The display and storage unit of claim 1 further comprising wheel assemblies for moving the unit when the sides and the counter top are in the closed position.

4. The display and storage unit of claim 1 wherein the base unit further comprises a work surface.

5. The display and storage unit of claim 1 wherein the display unit comprises a spline and the movable sides each comprise a pair of blocks spaced apart for receiving the spline of the display unit.

6. The display and storage unit of claim 1 wherein the counter top further comprises locking mechanisms for locking the counter top to the movable sides.

7. The display and storage unit of claim 1 wherein each of the movable sides are attached to the base unit by a hinge.

8. The display and storage unit of claim 1 wherein the counter top is attached to the front by a hinge.

9. The display and storage unit of claim 1 wherein the display unit has a backside for displaying merchandise.

10. A display and storage unit comprising:

a base unit having a front and a storage area within the base unit, a pair of movable sides attached to the base unit capable of being positioned between an open position and a closed position, a counter top attached to the front of the base unit capable of being positioned between an open position and a closed position, the counter top being positioned in the open position when the movable sides are in the open position, the pair of movable sides being secured to the counter top for securing the counter top and the sides in the open position, the movable sides further each comprising a pair of spaced apart blocks; and a display unit capable of being positioned on the base unit when the counter top and the sides are in the open position, the display unit comprising a spline, the spaced apart blocks for receiving the spline for securing the display unit to the base unit.

11. The display and storage unit of claim 10 wherein the display unit further comprises a pair of hook portions which are adapted to be positioned on the movable sides when the counter top and the movable sides are in the closed positions.

12. The display and storage unit of claim 10 wherein each of the movable sides has a leveling mechanism for leveling the unit when the movable sides are in the open position.

13. The display and storage unit of claim 10 further comprising wheel assemblies for moving the unit when the sides and the counter top are in the closed position.

14. The display and storage unit of claim 10 wherein the base unit further comprises a work surface.

15. The display and storage unit of claim 10 wherein the counter top further comprises locking mechanisms for locking the counter top to the movable sides.

16. The display and storage unit of claim 10 wherein each of the movable sides is attached to the base unit by a hinge.

17. The display and storage unit of claim 10 wherein the counter top is attached to the front by a hinge.

18. A display and storage unit comprising:

a base unit having a front and a storage area within the base unit, a pair of movable sides attached to the base unit capable of being positioned between an open position and a closed position, a counter top attached to the front of the base unit capable of being positioned between an open position and a closed position, the counter top being positioned in the open position when the movable sides are in the open position, the pair of movable sides being secured to the counter top for securing the counter top and the sides in the open position, the movable sides each further comprising a leveling mechanism for leveling the unit when the counter top and the sides are in the open position; and a display unit capable of being positioned on the base unit when the counter top and the side are in the open positions, the display unit further comprising a pair of hook portions which are adapted to be positioned on the movable sides when the counter top and the movable sides are in the closed positions.

* * * * *